United States Patent [19]

Yoshiura

[11] Patent Number: 4,963,928

[45] Date of Patent: Oct. 16, 1990

[54] ELECTROPHOTOGRAPHIC COPYING APPARATUS EQUIPPED WITH POSITIONING DEVICE

[75] Inventor: Syoichiro Yoshiura, Yamatokoriyama, Japan

[73] Assignee: Sharp Kabushiki Kaisha, Osaka, Japan

[21] Appl. No.: 279,413

[22] Filed: Dec. 2, 1988

[30] Foreign Application Priority Data

Dec. 4, 1987 [JP] Japan ..... 62-307125

[51] Int. Cl.[5] ..... G03G 15/00

[52] U.S. Cl. ..... 355/210; 355/237; 355/238

[58] Field of Search ..... 355/1, 237, 238, 210, 355/200

[56] References Cited

U.S. PATENT DOCUMENTS 4,632,536 12/1986 Sonobe et al. ..... 355/1 X
4,653,894 3/1987 Pease ..... 355/1

FOREIGN PATENT DOCUMENTS 54-116944 9/1979 Japan ..... 355/1
58-139162 8/1983 Japan .

*Primary Examiner*—R. L. Moses
*Attorney, Agent, or Firm*—Irell & Manella

[57] ABSTRACT

An electrophotographic copying apparatus including an optical unit that is installed into and removed from the body of said electrophotographic copying apparatus and an image-forming unit that is installed into and removed from the body of said electrophotographic copying apparatus, said optical unit being engaged with said image-forming unit by means of positioning pins and holes of both said optical means and said image-forming unit, so that the position of said image-forming unit with respect to said optical means can be fixed when said optical means and said image-forming unit are installed into the body of said electrophotographic copying apparatus.

7 Claims, 5 Drawing Sheets

ELECTROPHOTOGRAPHIC COPYING APPARATUS EQUIPPED WITH POSITIONING DEVICE

BACKGROUND OF THE INVENTION

1. Field of the Invention

This invention relates to electrophotographic copying apparatuses such as copying machines, laser printers, and the like.

2. Description of the Prior Art

When electrophotographic copying apparatuses such as copying machines are used for a long period of time, the photosensitive drum must be replaced, the developer must be added or replaced, the charging wires must be cleaned or replaced, the used toner must be replaced, and other such maintenance tasks must be done. Generally, these kinds of maintenance tasks take place during servicing or the like, but with the recent spread of the use of miniature copying machines, etc., some copying machines are being made in which a plurality of parts that are essential to form an image are incorporated into the body of the copying machines as a unit, and this unit can be removed from and replaced into the body of the copying machines, making it easy for the user to replace these parts.

In miniaturized copying machines mentioned above, as the optical means that conveys the image of light from the manuscript to the photosensitive drum, there is used a light-transmitting device through which light is converged (trade name, Selfoc lens), etc. This light-transmitting device is constructed so that it usually has a fixed magnification, so when the magnification of images to be obtained is to be changed, the light-transmitting device is replaced with another one with a different magnification.

However, as described above, when electrophotographic copying apparatuses such as copying machines and the like are constructed so as to have an image-forming unit and an optical means that can be installed into and removed from the body of the electrophotographic copying apparatus, the relative positions of the three parts, the body of electrophotographic copying apparatus, the image-forming unit, and the optical means, can readily shift, and when this occurs, the image that is formed is affected for the worse in terms of changes in the magnification, distortion of the image, and the like.

Japanese Laid-Open Patent Publication 58-139162 discloses a copying machine that comprises an optical means fixed to the body of the copying machine and a process kit. The position of the process kit is accurately decided with respect to the optical means by a positioning mechanism. In this way, because the said optical means is fixed to the body of the copying machine and cannot be replaced by another one with a different magnification, it is impossible for this copying machine to form images with a different magnification. Even though the said optical means were constructed to be removably incorporated into the body of the copying machine, because the process kit is mounted onto the said optical means, the said optical means cannot be replaced by another one without the removal of the process kit from the said optical means at the time when changes in the magnification of images are required.

SUMMARY OF THE INVENTION

The electrophotographic copying apparatus of this invention, which overcomes the above-discussed and numerous other disadvantages and deficiencies of the prior art, comprises an optical means that is installed into and removed from the body of said electrophotographic copying apparatus and an image-forming unit that is installed into and removed from the body of said electrophotographic copying apparatus, said optical means being engaged with said image-forming unit by means of positioning means of both said optical means and said image-forming unit, so that the position of said image-forming unit with respect to said optical means can be decided when said optical means and said image-forming unit are installed into the body of said electrophotographic copying apparatus.

In a preferred embodiment, the positioning means of said optical means are projections or holes that are engaged with said positioning means of said body that are holes or projections. The positioning means of said optical means also include projections or holes that are engaged with said positioning means of said image-forming unit that are holes or projections.

In a preferred embodiment, the image-forming unit comprises a housing and a photosensitive drum that is incorporated into the housing of said image-forming unit.

In a preferred embodiment, a processing unit is disposed around said photosensitive drum. The processing unit comprises a charging device. The processing unit further comprises a cleaning device.

In a preferred embodiment, the optical means is installed into and removed from the body of said electrophotographic copying apparatus through a hole that is extended, in the longitudinal direction of said photosensitive drum, above said photosensitive drum.

Thus, the invention described herein makes possible the objective of providing an electrophotographic copying apparatus in which the optical means has a positioning means by which the position of an image-forming unit with respect to the body of the electrophotographic copying apparatus is decided accurately and the positions of the optical means and the image-forming unit with respect to each other are also fixed accurately, so that the desired images can be obtained reliably.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
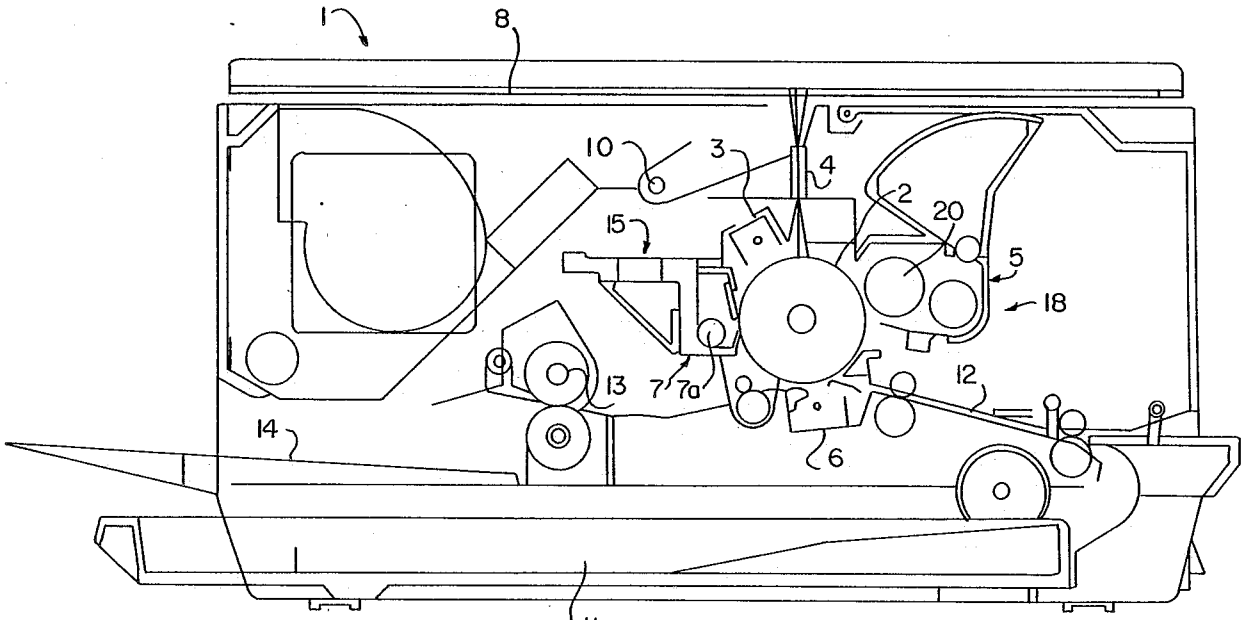
FIG. 1 is a sectional front view showing an electrophotographic copying apparatus of this invention.

FIG. 1 shows an electrophotographic copying apparatus of this invention that is an image-formation apparatus, which comprises a photosensitive drum 2 that is clockwise rotatable, a charging device 3, an optical means 4 that is a light-transmitting device by which light from a light source is converged on the photosensitive drum 2, a developing device 5, a transcription device 6, and a cleaning device 7. The abovementioned devices 3–7 are disposed around the photosensitive drum 2 in this order. The charging device 3 and/or the cleaning device 7 are incorporated into a processing unit that is disposed around the photosensitive drum 2.

On the body 1 of the electrophotographic copying apparatus, a manuscript plate 8 on which a manuscript is placed is disposed so that the manuscript plate 8 is movable from one side to the other of FIG. 1 by means of a driving mechanism (not shown). A light source 10 that radiates light onto the manuscript is disposed below the manuscript plate 8.

On the lower portion of the body 1 of the electrophotographic copying apparatus, a paper supply cassette 11 is disposed. Recording paper (not shown) from the paper supply cassette 11 is supplied to the photosensitive drum 2 via a route of conveyance 12 for recording paper. In the downstream direction of the photosensitive drum 2, a fixing device 13 and an ejection plate 14 are further disposed.

The formation of images is carried out by the use of the above-mentioned electrophotographic copying apparatus as follows: First of all, the photosensitive drum 2 is charged with static electricity at a fixed potential by the charging device 3. Then, the manuscript that has been placed on the manuscript plate 8 is irradiated with light from the light source 10. The light reflected from the manuscript radiates the photosensitive drum 2 via the light-transmitting device 4, resulting in an electrostatic latent image on the photosensitive drum 2 that corresponds to the pictures and/or letters of the manuscript. The electrostatic latent image is then developed by toner that is fed from the developing device 5, resulting in a toner image on the photosensitive drum 2. The toner image is transcribed onto recording paper from the paper supply cassette 11 by a transcription device 6, and then fixed on the recording paper by the fixing device 13. The recording paper on which the toner image has been fixed is ejected onto the plate 14. After the toner image has been transcribed onto recording paper, any toner remaining on the photosensitive drum 2 is removed and recovered by the cleaning device 7.

Figure 3:
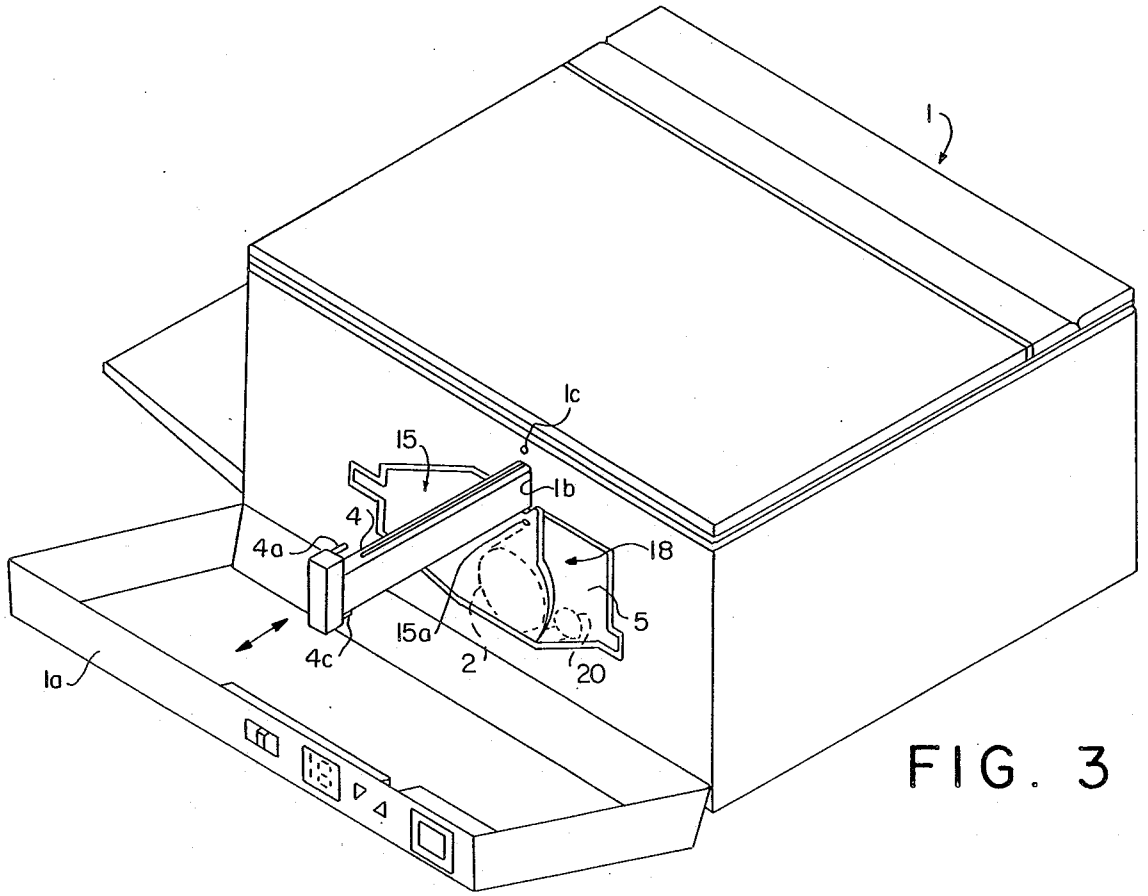
FIG. 3 is a perspective view showing the installation of a light-transmitting device into the body of the electrophotographic copying apparatus of FIG. 1.

As shown in FIG. 3, the front board of the body 1 of the electrophotographic copying apparatus that corresponds to the inside of the front cabinet 1*a* has a positioning means of the light-transmitting device 4, e.g., a hole 1*b*, above the photosensitive drum 2, which is extended in the longitudinal direction of the photosensitive drum 2. When the front cabinet 1*a* of the body 1 of the electrophotographic copying apparatus is opened, the light-transmitting device 4 can be installed into and removed from the body 1 of the electrophotographic copying apparatus 1 through the hole 1*b*. In general, the light-transmitting device 4 has a fixed magnification. Thus, when changes of the magnification of images to be obtained are required, the light-transmitting device 4 with a certain magnification can be readily replaced by another light-transmitting device with a different magnification.

Figure 2:
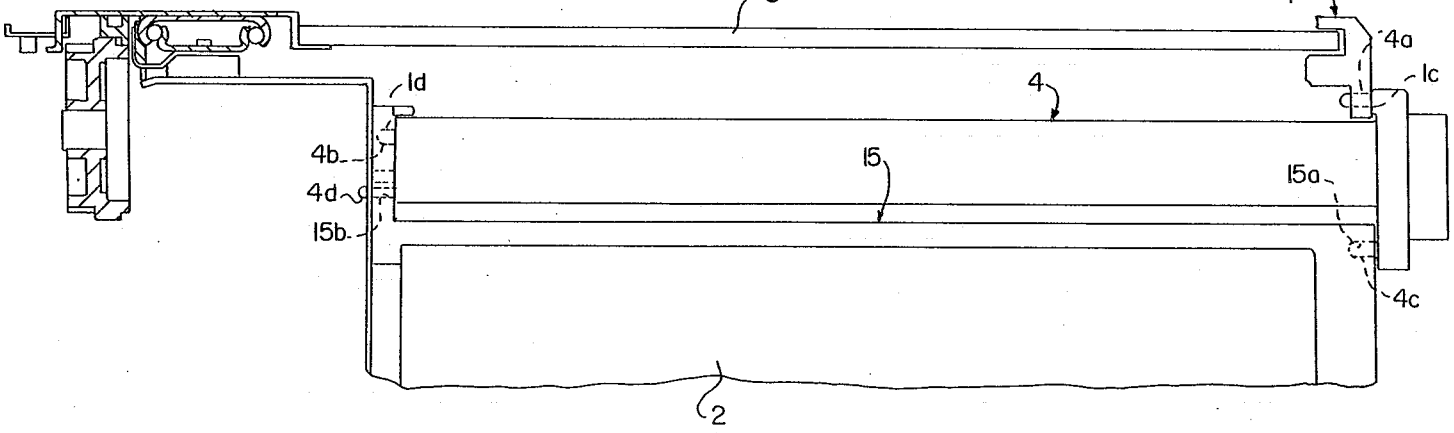
FIG. 2 is a side view showing an enlarged portion of the electrophotographic copying apparatus of FIG. 1.

As shown in FIG. 2, the light-transmitting device 4 has positioning means, e.g., positioning pins 4*a* and 4*b* that can be engaged with positioning means, e.g., positioning holes 1*c* and 1*d*, respectively, of the body 1 of the electrophotographic copying apparatus, and positioning means, e.g., positioning pins 4*c* and 4*d* that can be engaged with positioning means, e.g., positioning holes 15*a* and 15*b*, respectively, of the first image-forming unit 15 to be mentioned below.

Figure 4:
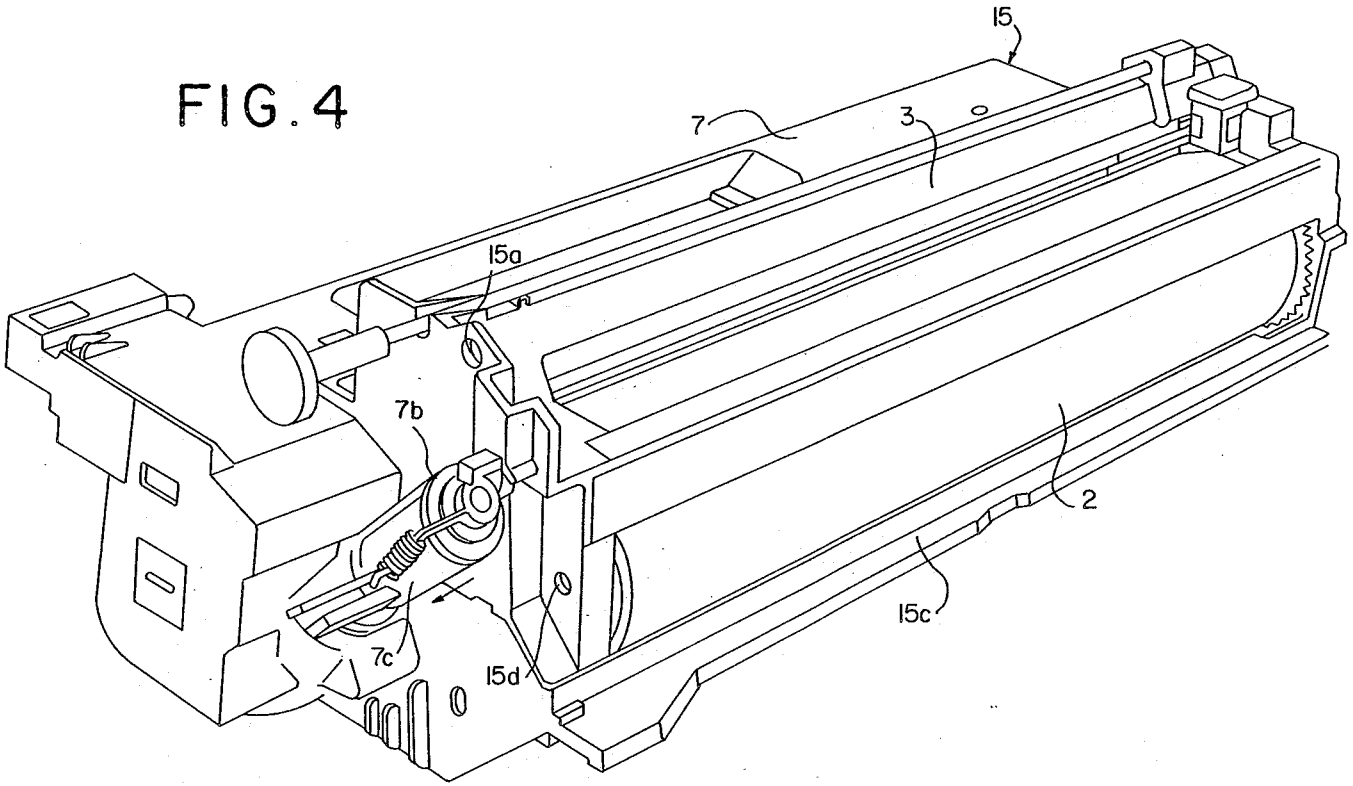
FIG. 4 is a perspective view showing a first image-forming unit to be used in the electrophotographic copying apparatus of FIG. 1.

FIG. 4 shows the above-mentioned first image-forming unit 15 that comprises the photosensitive drum 2, the charging device 3, and the cleaning device 7 in the housing of the image-forming unit 15. The cleaning device 7 is provided with a used toner-ejection opening 7*b* that has a lid 7*c*.

The used toner, which has been recovered by the cleaning device 7 from the surface of the photosensitive drum 2, is conveyed from the cleaning device 7 to the ejection opening 7*b* of a conveyance portion of the first image-forming unit 15 by means of a conveyance means 7*a* (FIG. 1) such as a conveyance screw, and then ejected from the ejection opening 7*b*. The used toner is carried from the ejection opening 7*b* to the opening of a used toner-collecting tank 17 (FIG. 5) that is a part of the second image-forming unit 18 to be mentioned below.

The housing of the first image-forming unit 15 is provided with a guiding portion 15*c*, in the longitudinal direction of the photosensitive drum 2, below the portion of the photosensitive drum 2 that is exposed to the outside of the housing of the first image-forming unit 15. The guiding portion 15*c* supports the second image-forming unit 18 in a manner to guide the second image-forming unit 18 to a given position of the body 1 of the electrophotographic copying apparatus when the second image-forming unit 18 is installed into the body 1 of the electrophotographic copying apparatus. The first image-forming unit 15 is provided with a positioning hole 15*d* that is engaged with a positioning boss 24 of the second image-forming unit 18.

The first image-forming unit 15 is fixed to the body 1 of electrophotographic copying apparatus by means of a guide-supporting means (not shown) of the body 1 of the electrophotographic copying apparatus so that the first image-forming unit 15 can be freely installed into and removed from the body 1 of the electrophotographic copying apparatus, making it easy for the user to replace the said unit by another. In order to remove the first image-forming unit 15 from the body 1 of the electrophotographic copying apparatus, the front cabinet 1*a* of the body 1 is opened and the light-transmitting device 4 is removed from the body 1, and thereafter the first image-forming unit 15 is removed from the body 1 of the electrophotographic copying apparatus. On the other hand, in order to install the first image-forming unit 15 into the body 1, the first image-forming unit 15 is inserted into the body 1 of the electrophotographic copying apparatus along the above-mentioned guide-supporting means of the body 1 and the light-transmitting device 4 is then inserted into the body 1 along the hole 1*b* of the body 1 so as to fasten the positioning pins 4*a* and 4*b* of the light-transmitting device 4 into the positioning holes 1*c* and 1*d* of the body 1, so that the position of the light-transmitting device 4 with respect to the body 1 can be decided. Moreover, the positioning pins 4*c* and 4*d* of the light-transmitting device 4 are engaged with the positioning holes 15*a* and 15*b* of the first image-forming unit 15, so that the position of the first image-forming unit 15 with respect to the light-transmitting device 4, (namely, the position of the first image-forming unit 15 with respect to the body 1 of the electrophotographic copying apparatus) can be fixed.

Figure 5:
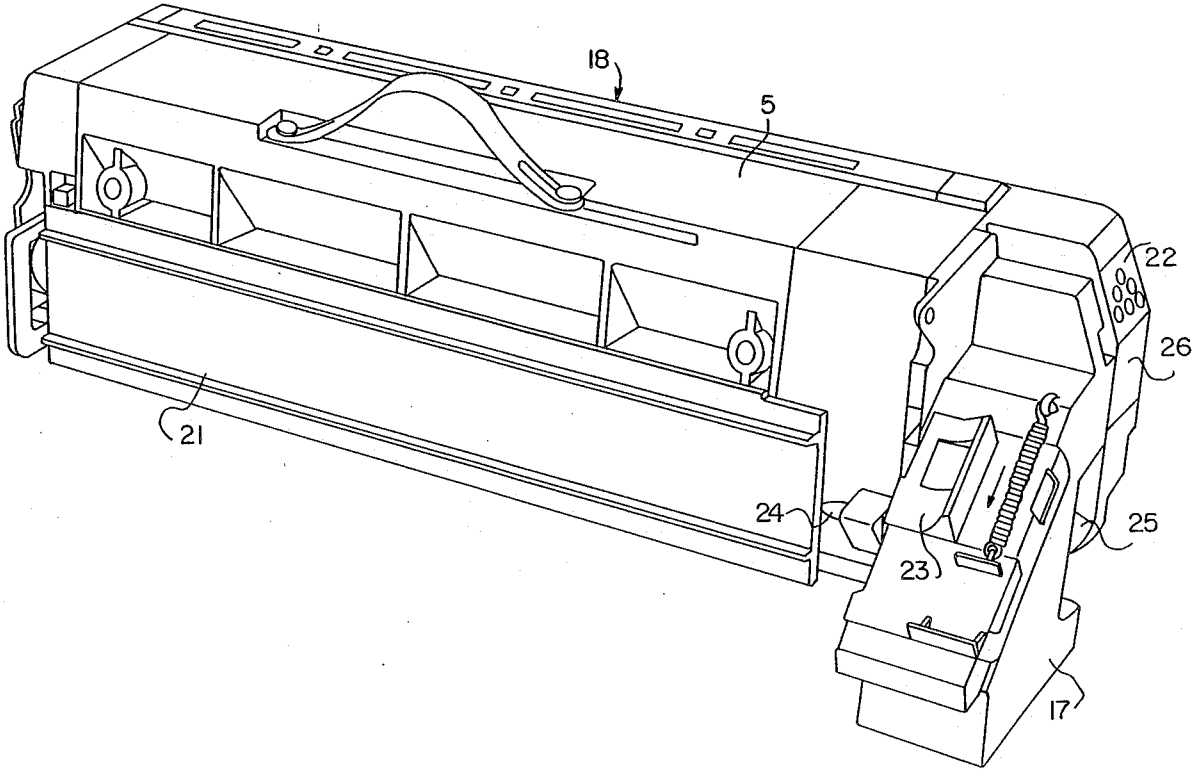
FIG. 5 is a perspective view showing a second image-forming unit to be used in the electrophotographic copying apparatus of FIG. 1.

FIG. 5 shows the above-mentioned second image-forming unit 18, which has a developing device 5 and a used toner-collecting tank 17. The developing device 5 has a cover 21 for covering a developing sleeve 20 (FIG. 1). The developing device 5 is provided with a label 22 that indicates the color of toner that is used for the formation of images. The indication of the label 22 can be seen through the window that is formed on the front cabinet 1*a* of the body 1 of the electrophotographic copying apparatus.

On the used toner-collecting tank 17, a slidable shutter 23 is disposed. The shutter 23 is closed while the second image-forming unit 18 is being removed from the body 1 of the electrophotographic copying apparatus, so that leakages of the used toner from the tank 17 can be prevented. The shutter 23 is slid in the arrow direction to open while the second image-forming unit 18 is being installed into the body 1, so that the opening of the tank 17 faces the opening 7*b* (FIG. 4) of the cleaning device 7 of the first image-forming unit 15.

The second image-forming unit 18 (FIG. 5) has a positioning boss 24 by which the position of the said second image-forming unit 18 with respect to the first image-forming unit 15 is fixed, a lock projection 25 by which the second image-forming unit 18 is fixed to the body 1 of the electrophotographic copying apparatus, and a grip 26 that the user grasps while the second image-forming unit 18 is being installed into the body 1 of the electrophotographic copying apparatus.

The second image-forming unit 18 is installed into the body 1 of the electrophotographic copying apparatus as follows: First of all, the first image-forming unit 15 is installed in the body 1 of the electrophotographic copying apparatus. Then, the cover 21 of the second image-forming unit 18 is opened to expose a magnet brush that has been formed on the surface of the developing sleeve 20, and the second image-forming unit 18 is inserted into the body 1 of the electrophotographic copying apparatus along the guiding portion 15*c* of the first image-forming unit 15. Then, the positioning boss 24 of the second image-forming unit 18 is engaged with the positioning hole 15*d* of the first image-forming unit 15 so that the position of the second image-forming unit 18 with respect to the first image-forming unit 15 is precisely fixed. Moreover, the second image-forming unit 18 is fixed to the body 1 of the electrophotographic copying apparatus by means of the locking projection 25 of the second image-forming unit 18. When the second image-forming unit 18 is removed from the body 1 of the electrophotographic copying apparatus, the same operation as mentioned above is performed in the reverse order.

The guiding portion 15*c* and the positioning hole 15*d* of the first image-forming unit 15 function to fix the position of the second image-forming unit 18 with respect to the first image-forming unit 15, so that the position of the magnet brush, which has been formed on the surface of the developing sleeve 20, with respect to the surface of the photosensitive drum 2 can be fixed accurately.

When a copying operation is carried out with a colored toner different from the colored toner that has been used for the formation of images, the second image-forming unit 18 with the developing device 5 is only replaced by another one. In this way, because the replacement of both the first image-forming unit 15 and the light-transmitting device 4 is unnecessary even when a copying operation with a colored toner different from that of the previous copying operation is needed, such a copying operation can be readily performed.

Although the above-mentioned example only discloses the application of this invention to a copying machine, this invention is, of course, applicable to electrophotographic copying apparatuses such as laser printers and other types of electrophotographic copying and printing machine.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An electrophotographic copying apparatus equipped with positioning devices, the copying apparatus comprising an optical means detachably mounted on the body of the copying apparatus, and an image-forming unit detachably mounted on the copying apparatus, the optical means being engaged with the image-forming unit, wherein the positioning devices comprise a first positioning means of the optical means, a second positioning means of the body of the copying apparatus, and a third positioning means of the image-forming unit so that the first positioning means is engaged with the second positioning means and the third positioning means so as to constitute an assembly of the body of the copying apparatus, the image-forming unit and the optical means.

2. An electrophotographic copying apparatus equipped with positioning means according to claim 1, wherein each positioning means comprises projections and holes adapted to be engageable with holes and projections of the respective mating positioning means.

3. An electrophotographic copying apparatus according to claim 1, wherein said image-forming unit comprises a housing and a photosensitive drum that is incorporated into the housing of said image-forming unit.

4. An electrophotographic copying apparatus according to claim 3, wherein a processing unit is disposed around said photosensitive drum.

5. An electrophotographic copying apparatus according to claim 4, wherein said processing unit comprises a charging device.

6. An electrophotographic copying apparatus according to claim 5, wherein said processing unit further comprises a cleaning device.

7. An electrophotographic copying apparatus according to claim 3, wherein said optical means is installed into and removed from the body of said electrophotographic copying apparatus through a hole that is extended, in the longitudinal direction of said photosensitive drum, above said photosensitive drum.

* * * * *